US007828225B2

(12) United States Patent
Cunningham

(10) Patent No.: US 7,828,225 B2
(45) Date of Patent: Nov. 9, 2010

(54) CATALYST DELIVERY SYSTEM AND METHOD THEREFOR

(76) Inventor: Emmett Manuel Cunningham, 4155 E. Rockledge Rd., Phoenix, AZ (US) 85044

( * ) Notice: Subject to any disclaimer, the term of this patent is extended or adjusted under 35 U.S.C. 154(b) by 337 days.

(21) Appl. No.: 12/124,066

(22) Filed: May 20, 2008

(65) Prior Publication Data

US 2009/0288627 A1 Nov. 26, 2009

(51) Int. Cl.

| | |
|---|---|
| ***B05B 17/06*** | (2006.01) |
| ***B05B 17/04*** | (2006.01) |
| ***B05B 1/08*** | (2006.01) |
| ***B05B 7/30*** | (2006.01) |
| ***F02B 51/02*** | (2006.01) |

(52) U.S. Cl. ..... 239/4; 239/102.2; 239/124; 239/338; 239/340; 239/352; 123/670

(58) Field of Classification Search ..... 239/4, 239/102.1, 102.2, 124, 338, 340, 350, 352; 123/198 R, 198 A, 670; 431/4, 190
See application file for complete search history.

(56) References Cited

U.S. PATENT DOCUMENTS

| | | | | |
|---|---|---|---|---|
| 4,995,367 | A | 2/1991 | Yamauchi et al. | |
| 5,085,841 | A | 2/1992 | Robinson | |
| 6,176,701 | B1 | 1/2001 | Robinson | |
| 6,357,671 | B1 | 3/2002 | Cewers | |
| 6,419,477 | B1 | 7/2002 | Robinson | |
| 6,786,714 | B2 | 9/2004 | Haskew | |
| 7,584,905 | B2 | 9/2009 | Cunningham et al. | |
| 2003/0234012 | A1 * | 12/2003 | Bosteels | 123/670 |
| 2004/0124259 | A1 | 7/2004 | Guezennec et al. | |
| 2006/0102743 | A1 | 5/2006 | Cunningham et al. | |
| 2006/0112906 | A1 | 6/2006 | Cunningham et al. | |
| 2006/0254260 | A1 | 11/2006 | Telford | |
| 2008/0097679 | A1 | 4/2008 | Keays | |
| 2008/0121736 | A1 | 5/2008 | Mao et al. | |

* cited by examiner

*Primary Examiner*—Darren W Gorman
(74) *Attorney, Agent, or Firm*—Hoffman Warnick LLC

(57) ABSTRACT

A system and method for delivering catalytic molecular structure to a combustion chamber is disclosed. Catalyst base materials are reduced to a micronic fog by a device using the ultrasonic vibration of a piezoelectric disc. The liquid base materials evaporate instantly upon entering the engines air stream therefore releasing pure catalyst molecules into the combustion zone, thus reducing the time taken for catalytic combustion to the lowest denominator possible and allowing for the greatest effect achievable. This further reduces the amount of catalyst needed in the base solution compared to any other type of device or additive. The system also allows a user to control the delivery rate of the catalyst to the combustion chamber.

18 Claims, 6 Drawing Sheets

Fig. 6
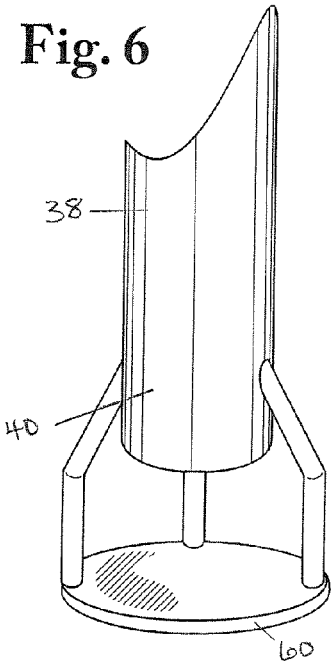
Fig. 7
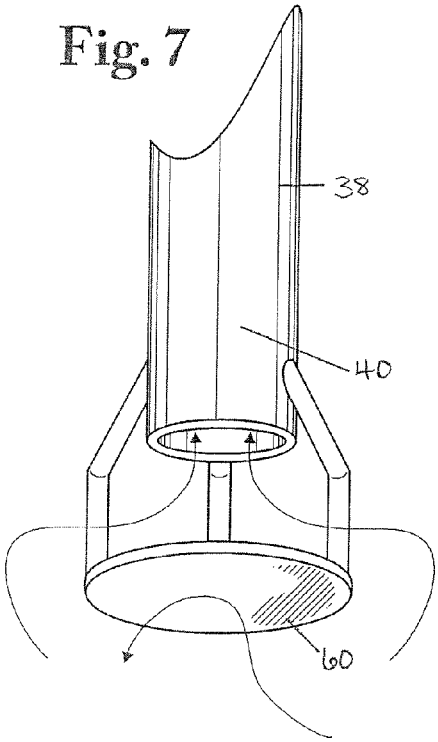
Fig. 8
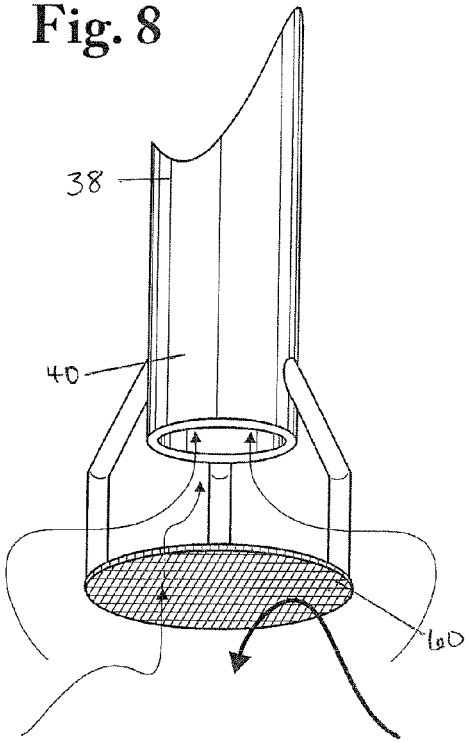
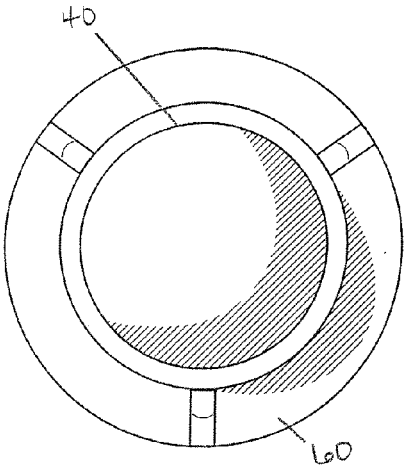
Fig. 9

CATALYST DELIVERY SYSTEM AND METHOD THEREFOR

FIELD OF THE INVENTION

This invention relates generally to combustion and, more specifically, to a catalyst delivery system for delivering a controlled amount of catalyst in a molecular form to a combustion chamber.

BACKGROUND OF THE INVENTION

The concept of adding a catalyst to a combustion process is not new. However, there is no proven process that gives greater catalytic effect on combustion than for the catalyst to be proportionally and correctly mixed with the incoming air stream.

Some have attempted to coat the combustion chamber with nanoparticles. But, this has not been very successful because the combustion chamber will not stay coated under the extreme conditions of temperature and pressure. To try to recoat the combustion chamber by adding varying nanosubstances (solids) or dissolved rare earth compounds to the incoming air stream are not reliable, controllable or efficient. Simply coating the surfaces of a combustion chamber will have an effect at the outer edges of the combustion, but not at the core or ignition point and throughout the combustion.

Others have tried to add catalytic solutions directly to the fuel. However, the catalyst is weakened by the sheer nature of the catalyst molecules having to release themselves from the fuel molecules before having a catalytic effect on the overall combustion reaction in the millisecond that the combustion lasts.

Others have also simply placed Platinum balls into the fuel line or fuel tank, expecting the Platinum molecules to release into the fuel and cause a catalytic effect. Each of the aforementioned methods may have some level of success, but none of them seems to have a way to control the amount or the quality of catalyst delivered. Also, none of them appear to address a controlled repeatability and correct ratio of catalyst to fuel or the longevity of the catalyst delivery process.

Therefore, a need exists for a delivery system that improves the amount of actual catalytic material that reaches the combustion chamber. A need also exists for a delivery system that allows a user to control the delivery rate of the catalyst to the combustion chamber. One of the primary purposes of the invention is to reduce the overall fuel consumption of combustion devices and at the same time reduce the gaseous pollution and particulate matter created by the inefficient combustion of today's engines. It is a well known fact that catalyst(s) have a positive effect on combustion. What has always been a challenge is a way to control the amount and size of the catalyst to achieve the greatest effect on the combustion and this invention does that.

SUMMARY OF THE INVENTION

It is an object of the present invention to provide a delivery system that improves the amount of catalyst that reaches a combustion chamber.

It is another object of the present invention is to provide a catalyst delivery system that reduces the overall fuel consumption of combustion devices.

Another object of the present invention is to provide a catalyst delivery system that reduces particulate matter created by inefficient combustion in present day engines.

Another object of the present invention is to provide a catalyst delivery system that reduces the overall pollution, e.g. NOx, Co2, etc., created by inefficient combustion in present day engines.

Still another object of the present invention is to provide a catalyst delivery system that reduces the engine and exhaust temperatures created by inefficient combustion in present day engines.

Still another object of the present invention to provide a delivery system that allows a user to control the delivery rate of catalyst to a combustion chamber based on the amount of fuel being consumed.

Yet another object of the present invention is to provide a delivery system that allows a user to control the size of the catalytic molecules to achieve the greatest effect on combustion.

BRIEF DESCRIPTION OF THE PREFERRED EMBODIMENTS

In accordance with one embodiment of the present invention, a dry micro fog device for a combustion engine is disclosed. The device comprises a hollow chamber having a collection area for base materials, a piezoelectric disc for transforming base materials into a micro aerosol, wherein the piezoelectric disc is coupled to the hollow chamber, below the collection area, a top cover sealing a top portion of the hollow chamber, wherein the cover has an opening for delivering the micro aerosol from the hollow chamber to an air intake of the combustion engine, and a bottom cover sealing a bottom portion of the hollow chamber.

In accordance with another embodiment of the present invention, a catalyst delivery system for a combustion engine is disclosed. The delivery system comprises an amount of liquid containing at least one catalyst, a hollow chamber having a collection area for the liquid, a piezoelectric disc for transforming the liquid into a micro aerosol, wherein the piezoelectric disc is coupled to the hollow chamber, below the collection area, a top cover sealing a top portion of the hollow chamber, wherein the cover has an opening for delivering the micro aerosol from the hollow chamber to an air intake of the combustion engine, a bottom cover sealing a bottom portion of the hollow chamber, and a control mechanism for maintaining a constant level of liquid in the collection area.

In accordance with another embodiment of the present invention, a method for delivering catalyst to a combustion engine is disclosed. The method comprises the step of providing a dry micro fog device comprising a hollow chamber having a collection area, a piezoelectric disc coupled to the hollow chamber and coupled below the collection area, a top cover sealing a top portion of the hollow chamber, wherein the cover has an opening, and a bottom cover sealing a bottom portion of the hollow chamber. The method comprises the further steps of providing a liquid catalyst solution in the collection area, vibrating the piezoelectric disc, reducing the liquid catalyst solution to a micro aerosol comprising catalytic molecules that are between approximately 1.7 microns to 3 microns in size, and creating a venturi effect with the air flowing through the air intake to draw the aerosol from the hollow chamber into the air intake through the opening of the top cover.

The foregoing and other objects, features, and advantages of the invention will be apparent from the following, more particular description of the preferred embodiments of the invention, as illustrated in the accompanying drawings.

BRIEF DESCRIPTION OF THE DRAWINGS

FIG. 6 is a top perspective view of the delivery tube and splash guard of the dry fog device.

FIG. 7 is a bottom perspective view of the delivery tube and splash guard of FIG. 6.

FIG. 8 is a top perspective view of another embodiment of the delivery tube and splash guard of the dry fog device.

FIG. 9 is a top view of the delivery tube and splash guard of the dry fog device of FIG. 6.

DETAILED DESCRIPTION OF THE PREFERRED EMBODIMENTS

Figure 1:
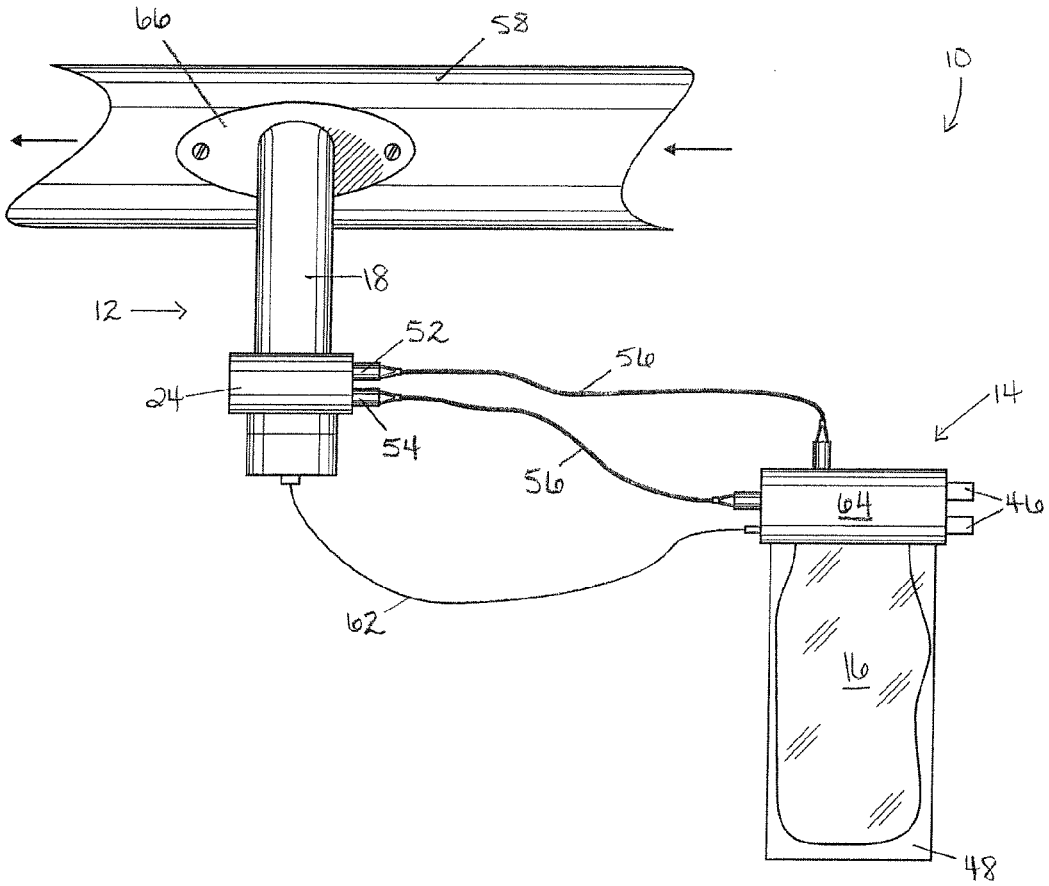
FIG. 1 is a front view of one embodiment of a catalyst delivery system of the present invention.

The novel features believed characteristic of the invention are set forth in the appended claims. The invention will best be understood by reference to the following detailed description of illustrated embodiments when read in conjunction with the accompanying drawings, wherein like reference numerals and symbols represent like elements.

FIGS. 1-9 show a catalyst delivery system for a combustion engine, referred to as system 10, of the present invention. The system 10 comprises a dry micro fog device 12 and a control mechanism 14 to control the amount of catalyst that reaches the combustion chamber, piezoelectric frequency, and the delivery rate of catalyst to a combustion chamber.

Referring to FIG. 1, an embodiment of the catalyst delivery system 10 is shown. The dry fog device 12 is shown coupled to a side portion of an air intake 58 of a combustion engine. It should be clearly understood, however, that substantial benefit may be derived from the dry fog device 12 being coupled to a different portion of the air intake 58. The dry fog device 12 converts base materials, such as a catalytic solution 16, into a micro aerosol 17 that is then delivered into the air intake 58. It should be clearly understood that the base materials may be water, water/glycol, oil, alcohol, esters, etc.

Maintaining an optimal level of catalytic solution 16 above the piezoelectric disc 26, maintains the peak of efficiency of the micro aerosol 17 (see FIG. 4) output at all times and allows the piezoelectric disc 26 to operate for the longest length of time. The level of catalytic solution 16 will depend upon the type of liquid being nebulized; oil, water, water/glycol, etc. The viscosity of the liquid will determine the level in the collection area 24 that will provide for the best micronic fog effect.

In this embodiment, the system 10 has a supply of additional catalytic solution 16 that may be added to the collection area 24 through an inlet valve 52. In FIG. 1 the additional catalytic solution 16 is held in a housing 48 and the flow of the catalytic solution 16 to and from the housing 48 is controlled by the control mechanism 14. The additional catalytic solution 16 may be stored directly in the housing 48 or, for convenience, may be kept in disposable bags placed within the housing 48. Furthermore, the housing 48 may be available in several sizes, allowing it to hold various amounts of catalyst solution, depending upon the maintenance cycle of the combustion engine.

When the amount of catalytic solution 16 in the collection area 24 falls below a desired level, additional catalytic solution 16 will be pumped from the housing 48 and to the collection area 24 via a length of tubing 56 that connects the housing 48 to the inlet valve 52. In order to maintain an optimal level of catalytic solution 16 in the collection area 24 above the piezoelectric disc 26 (see FIGS. 2-3), the dry fog device 12 also has an outlet valve 54 that allows any overflow of catalytic solution 16 to be drained from the collection area 24 and pumped to the housing 48 via another length of tubing 56 that connects the outlet valve 54 to the housing 48. As shown, the outlet valve 54 is positioned at a level below the inlet valve 52 and is positioned at the desired level.

In another embodiment, the control mechanism 14 may comprise a sensor placed within the collection area 24 for identifying the level of catalytic solution 16 remaining in the collection area 24. Once the sensor detects that the level of catalytic solution 16 has fallen below the desired level, the control mechanism 14 will then pump additional catalytic solution 16 to the collection area 24 via tubing 56 connecting the housing 48 to the inlet valve 52.

As shown in FIG. 1, the control mechanism 14 of the system 10 comprises a pump and electronics assembly 64. The control mechanism 14 also has inputs 46 to receive power from the engine and/or an independent power source. The tubing 56 connected to the inlet valve 52 and outlet valve 54 are also connected to the pump and electronics assembly 64 of the control mechanism 14. Electrical wiring 62 also connects the piezoelectric disc 26 of the dry fog device 12 to the control mechanism 14.

The control mechanism 14 is shown in FIG. 1 as being coupled to the housing 48 and shown separated from the dry fog device 12. This allows the pump and electronics assembly 64, the driver circuit, and power connections to be held remote from any sonic vibration or disruptive impact vibration destruction caused by the dry fog device 12 when the piezoelectric disc 26 is being operated. While this is preferred, it should be clearly understood that substantial benefit may still be derived from the control mechanism 14 being coupled directly to the dry fog device 12. While this is the control mechanism 14 shown in the Figures, it should be clearly understood that any suitable control mechanism 14 may be used to control the flow of catalytic solution 16 between the dry fog device 12 and the housing 48 containing additional catalytic solution 16.

Referring now to FIGS. 2-5, the dry fog device 12 of the system 10 is shown coupled to an air intake 58. In this embodiment, the dry fog device 12 has a hollow chamber 18. While the hollow chamber 18 is shown as being L-shaped and attached to the side of the air intake 58, it should be clearly understood that substantial benefit may be derived from the hollow chamber 18 having an alternative shape and being coupled to a different area of the air intake 58.

A docking station 66 is coupled over an opening 82 in the air intake 58. The docking station 66 is shown as having a curved portion 68 that conforms to the curve of the air intake 58 and has an opening 84 that is aligned with the opening 82 in the air intake 58. The docking station 66 also has a straight portion 70 that connects to a top portion 20 of the hollow chamber 18. The straight portion 70 of the docking station 66 and the top portion 20 of the hollow chamber 18 may be threaded and held together by a locking ring (shown in FIG. 5). However, it should be clearly understood that the straight portion 70 of the docking station 66 and the top portion 20 of the hollow chamber 18 may be coupled in any other suitable way as long as an air tight connection is created between the air intake 58 and the dry fog device 12.

The hollow chamber 18 has a collection area 24 (shown in FIGS. 2-4) near a bottom portion 22 of the hollow chamber 18. Base materials, such as catalyst solution 16 are held in the collection area 24. While it is shown that the base materials be a liquid catalyst solution 16, it should be clearly understood that substantial benefit may still be derived from the base materials being in gel or powder form.

A nebulizer, such as a piezoelectric disc 26 (shown in FIGS. 2-3), is located near the bottom portion 22 of the hollow chamber 18, below the collection area 24. The piezoelectric disc 26 transforms the catalyst solution 16 into an aerosol 17 (shown in FIG. 4) within the hollow chamber 18. A bottom cover 34 seals the bottom portion 22 of the hollow chamber 18 and is shown as defining a recessed area 36 (shown in FIGS. 2-3) for housing the piezoelectric disc 26. The bottom cover 34 is also shown as housing the electrical wires 62 (shown in FIGS. 2-3) that connect the piezoelectric disc 26 to the pump and electronics assembly 64 of the control mechanism 14. The bottom cover 34 is shown as being threaded to correspond with a threaded bottom portion 22 of the hollow chamber 18. It should be clearly understood, however, that the bottom cover 34 may be coupled to the bottom portion 22 of the hollow chamber 18 in any suitable way as long as an air-tight connection is formed.

The dry fog device 12 may also have anti-splashing material, such as open cell foam 74 (shown in FIGS. 2-4), placed within the collection area 24 for preventing splashing within the collection area 24 during the vibrations caused by the operating engine and/or the equipment that the engine is housed in. The open cell foam 74 is shown conforming to the shape of the hollow chamber 18, lining the inner walls of the collection area 24. The open cell foam 74 will also define a hollow center portion 76 directly above the piezoelectric disc 26, allowing the piezoelectric disc 26 to be submerged in the catalytic solution 16. The bottom portion 22 of the hollow chamber 18 is also shown defining a flange 78 (shown in FIGS. 2-4), on top of which the open cell foam 74 will sit.

Figure 2:
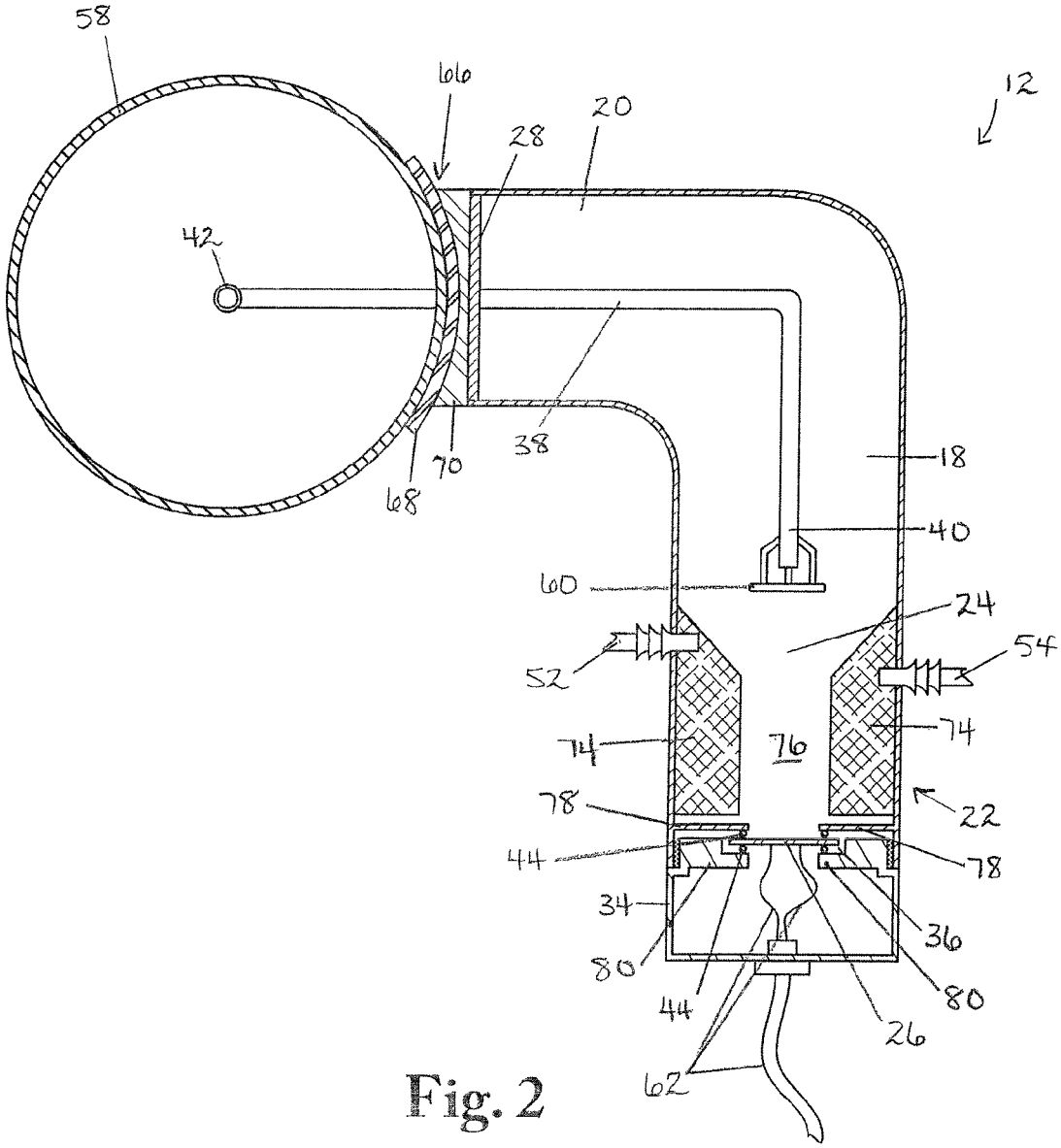
FIG. 2 is a side cross-sectional view of the dry fog device of the catalyst delivery system of FIG. 1.
Figure 3:
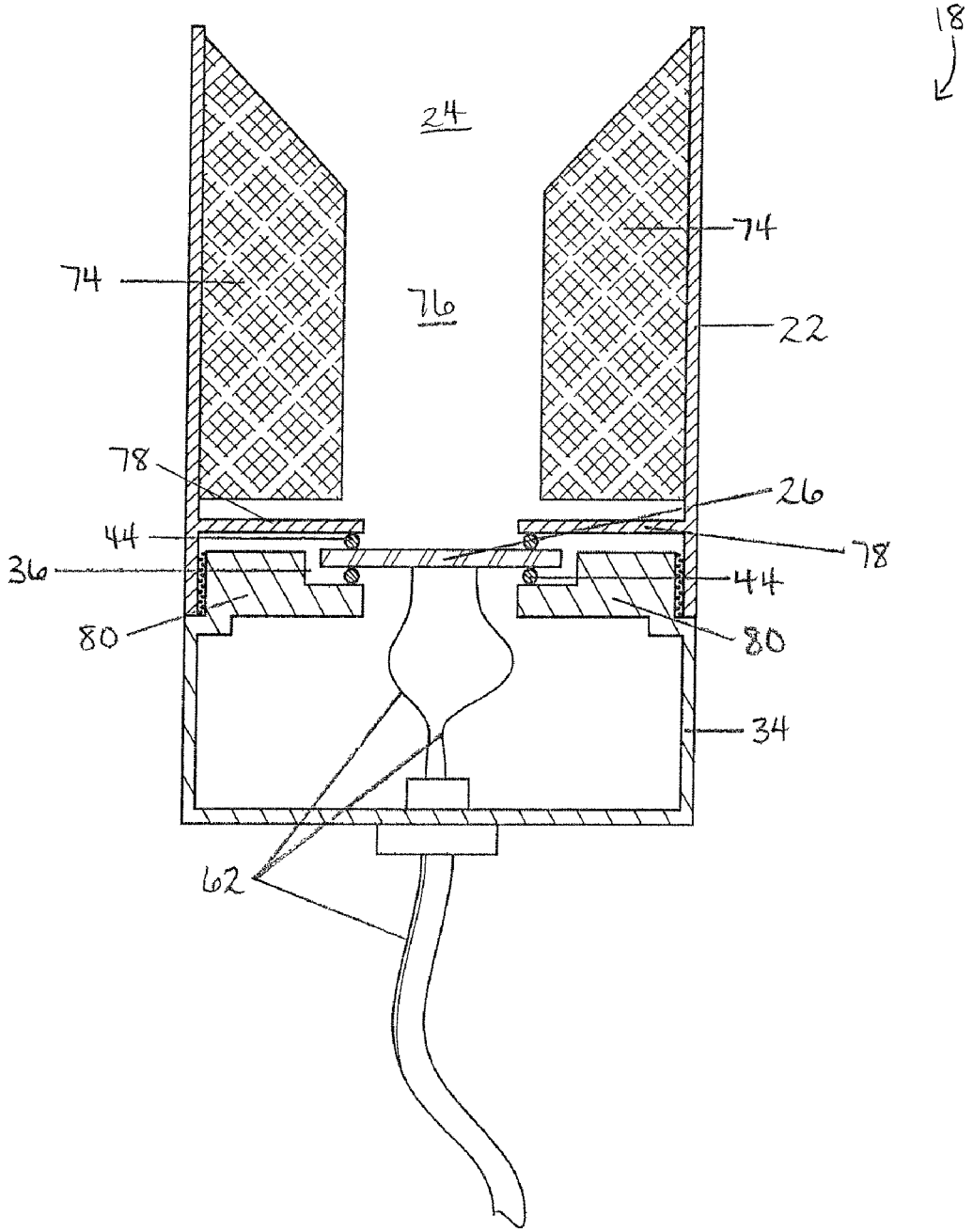
FIG. 3 is a cross sectional view of the collection area, bottom cover, and piezoelectric disc of the dry fog device of FIG. 2.
Figure 4:
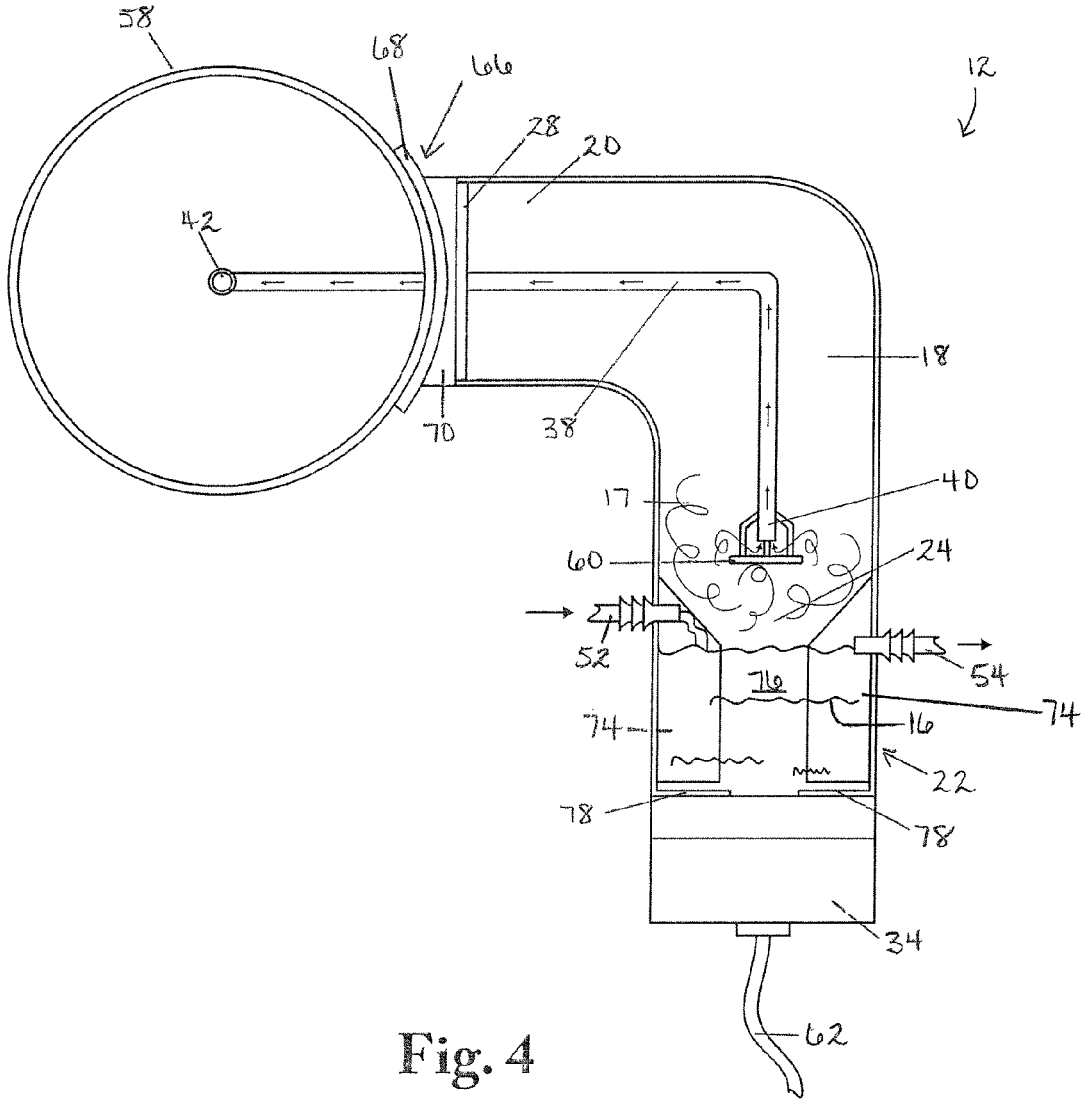
FIG. 4 is a side internal view of the dry fog device of FIG. 2.

As shown in FIGS. 2 and 3, when the bottom cover 34 is coupled to the bottom portion 22 of the hollow chamber 18, the recessed area 36 of the bottom cover 34 comprises a flange 80 that is aligned with the flange 78 of the bottom portion 22 of the hollow chamber 18. The piezoelectric disc 26 is situated between two O-rings 44; one O-ring 44 placed below the flange 78 of the bottom portion 22 of the hollow chamber 18 and one O-ring 44 placed above the flange 80 of the bottom cover 34. This O-ring configuration reduces leakage from the collection area 24 and keeps the piezoelectric disc 26 in place within the recessed area 36 of the bottom cover 34.

Figure 5:
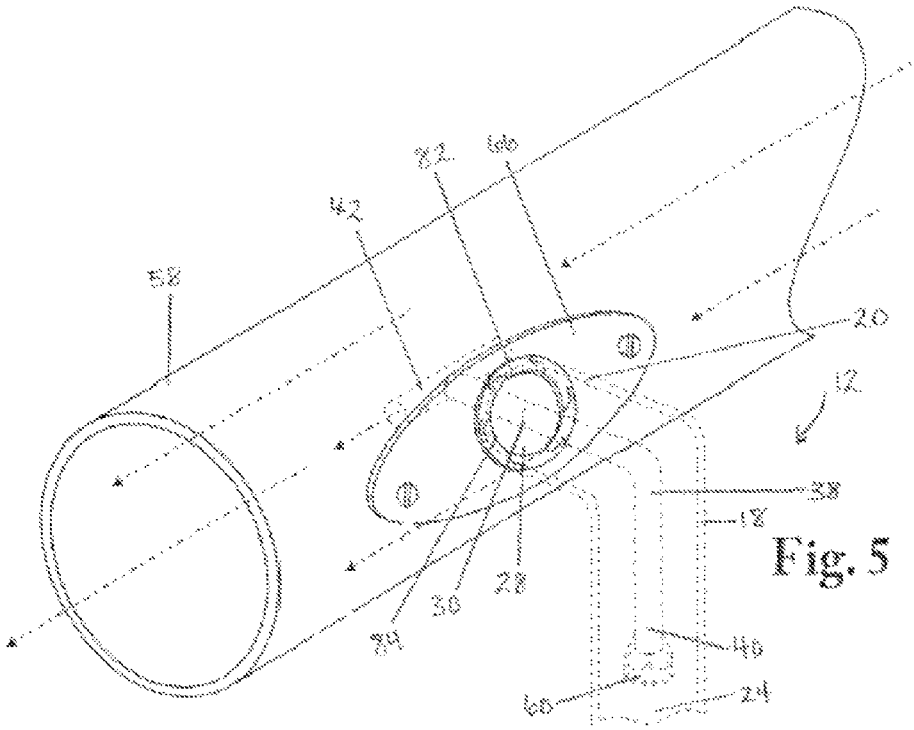
FIG. 5 is an elevated perspective view of the catalyst delivery system of FIG. 1 with the dry fog device shown in phantom lines coupled at the docking station on the air intake.
Figure 5B:
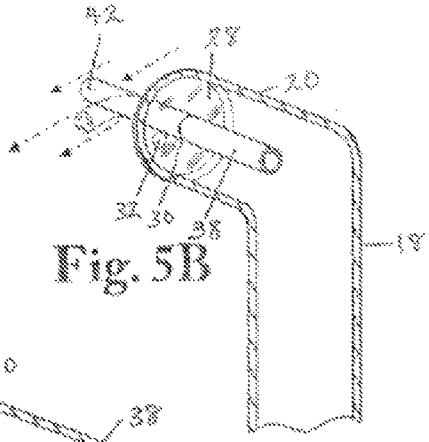
FIG. 5B is an elevated perspective internal view of another embodiment of the dry fog device.
Figure 5A:
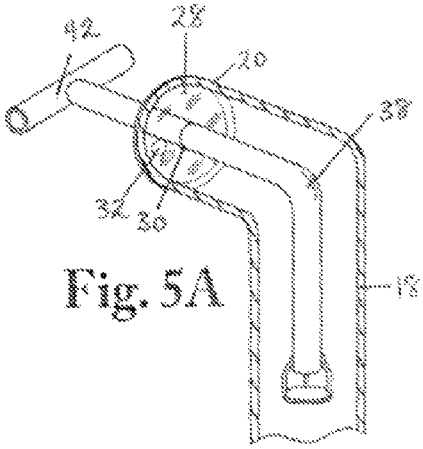
FIG. 5A is an elevated perspective internal view of the dry fog device of FIG. 2.
Figure 5C:
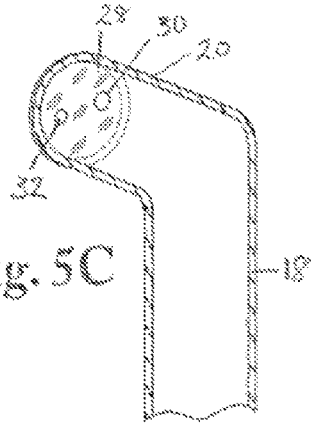
FIG. 5C is an elevated perspective internal view of another embodiment of the dry fog device.

Referring to FIGS. 5A-5C, the dry fog device 12 also has a top cover 28 that seals the top portion 20 of the hollow chamber 18. The top cover 28 has an opening 30 for delivering aerosol 17 from the hollow chamber 18 to the air intake 58 of the combustion engine. Airflow within the air intake 58 blows across the opening 30, creating a venturi effect, thereby causing the aerosol 17 to be pulled from the hollow chamber 18 through the opening 30 in the top cover 28 and into the air intake 58. The top cover 28 may also have a pressure balance hole 32 to relieve any excess negative pressure in the hollow chamber 18, though one is not required.

In another embodiment, the dry micro fog device 12 may have a delivery tube 38 (shown in FIGS. 2, 4, 5, 5A, and 5B) that passes through the opening 30 of the top cover 28. The delivery tube 38 has a first end 40 that is located within the hollow chamber 18 and is located above the collection area 24. The delivery tube 38 also has a second end 42 that is located within the air intake 58. The second end 42 of the delivery tube 38 is preferably placed at a specific position within the air intake to ensure optimal function. This specific position is determined according to the size of the air intake 58 and the velocity of the air blowing through the air intake 58. Generally, the second end 42 of the delivery tube 38 will be placed more than one quarter inch away from the inner perimeter of the air intake 58. This will assure that the delivery tube 38 is not placed in the eddy of the air stream in the intake 58, whether reverse or turbulent air stream.

In the embodiment shown in FIG. 5B, airflow within the air intake 58 blows across the open second end 42 of the delivery tube 38 creating a venturi effect, thereby causing the aerosol 17 to be pulled from the hollow chamber 18 through the delivery tube 38 and into the air intake 58. The second end 42 of the delivery tube 38 may flex due to the violence of the venturi effect.

As shown in FIGS. 5-5A, the second end 42 of the delivery tube 38 may be T-shaped so that a portion of the second end 42 is in line with the air intake 58. Airflow within the air intake 58 will blow through the open T-shaped second end 42 creating a venturi effect within the T-shaped second end 42, thereby causing the aerosol 17 to be pulled from the hollow chamber 18 through the delivery tube 38 and into the air intake 58. This T-shaped configuration reduces the violence of the venturi effect.

Referring to FIGS. 6-9, the dry fog device 12 may also have a splash guard 60 (also shown in FIGS. 2, 4, and 5) coupled to the first end 40 of the delivery tube 38 for preventing large particles of catalytic solution 16 from entering the delivery tube 38. The splash guard 60 is shown as being a disc coupled to the first end 40 by a plurality of prongs. The splash guard 60 may be solid (shown in FIGS. 6, 7, and 9) or the splash guard may be porous (shown in FIG. 8). It should be clearly understood that the splash guard 60 may be coupled to the first end 40 in any suitable way as long as the open first end 40 is not obstructed. It should also be clearly understood that substantial benefit may be derived from the splash guard 60 being integral to the first end 40 or from there being no splash guard 60.

All component parts, including plastics, wiring, tubes, connectors, metals and catalyst are designed to withstand the atmospheric conditions and the contamination conditions in or around the combustion engine.

Statement of Operation

The catalyst delivery system 10 may be constructed with a combustion engine, or more preferably, will be adaptable to an existing combustion engine. In the case of an existing combustion engine, an opening 82 in the air intake 58 must be made. A docking station 66 will be coupled to the air intake 58, making sure to align the opening 84 of the docking station 66 with the opening 82 in the air intake 58. The top portion 20 of the hollow chamber 18 will then be coupled to the straight portion 70 of the docking station 66. If a delivery tube 38 is used, the second end 42 of the delivery tube 38 should be positioned at its optimal location within the air intake 58.

The collection area 24 of the hollow chamber 18 will be filled with catalytic solution 16. The piezoelectric disc 26 may then be operated and controlled by the control mechanism 14. By controlling the voltage, a user may control the piezoelectric disc 26 frequency and therefore control the aerosol output (consumption of catalytic solution 16). This will assure reduction in pollution and fuel consumption.

The piezoelectric disc 26 may be operated at frequencies between approximately 1.6-2.4 megahertz, thus creating an aerosol 17 (or dry fog) of catalytic molecules between approximately 1.7-3 microns in size. These molecules are so small that they quickly evaporate when introduced into the in-coming air stream in the air intake 58, thereby releasing pure unattached catalyst into the combustion zone. This not only increases the catalytic effect and reliability, but also simultaneously reduces the amount of catalyst needed in the base solution. Furthermore, the greatly reduced size of the catalyst molecules reduces the possibility of the catalyst attaching to any surface before reaching the combustion engine.

The piezoelectric disc 26 has a finite life cycle which has been greatly increased by the present invention. The control mechanism 14 causes the piezoelectric disc 26 to have an ON/OFF cycle from approximately 10-20 milliseconds to approximately 10-40 milliseconds (and so on). By having the OFF cycle of the piezoelectric disc 26 set at 1-4 times the length of the ON cycle, the life cycle of the piezoelectric disc 26 is increased exponentially. This will also control the amount of aerosol 17 outflow. The ON/OFF cycles may be changed as needed to extend the life of the piezoelectric disc 26 as desired.

While the invention has been particularly shown and described with reference to preferred embodiments thereof, it will be understood by those skilled in the art that the foregoing and other changes in form and details may be made therein without departing from the spirit and scope of the invention.

I claim:

1. A dry micro fog device for a combustion engine comprising:

a hollow chamber having a collection area for base materials;

a piezoelectric disc for transforming base materials into a micro aerosol, wherein the piezoelectric disc is coupled to the hollow chamber, below the collection area;

a top cover sealing a top portion of the hollow chamber, wherein the cover has an opening for delivering the micro aerosol from the hollow chamber to an air intake of the combustion engine;

a delivery tube for delivering the micro aerosol from the hollow chamber to the air intake, wherein the delivery tube passes through the opening of the top cover, the delivery tube having a first end located within the hollow chamber and above the collection area and having a second end located within the air intake; and a bottom cover sealing a bottom portion of the hollow chamber.

2. The dry micro fog device of claim 1 wherein the base materials contain at least one catalyst.

3. The dry micro fog device of claim 1 wherein the top cover also has a pressure balance hole.

4. The dry micro fog device of claim 1 further comprising a control mechanism for maintaining a constant level of base materials in the collection area.

5. The dry micro fog device of claim 4 wherein the control mechanism comprises:

a housing containing additional base materials;

at least one pump;

an inlet valve coupled to the collection area;

an outlet valve for draining base materials from the collection area, wherein the outlet valve is coupled below the inlet valve and at the desired level;

tubing connecting the housing to the inlet valve; and tubing connecting the housing to the outlet valve.

6. The dry micro fog device of claim 1 further comprising a guard coupled to the first end of the delivery tube for preventing large particles from entering the delivery tube.

7. The dry micro fog device of claim 1 wherein the second end of the tube is T-shaped.

8. The dry micro fog device of claim 1 wherein the bottom cover defines a recessed area for housing the piezoelectric disc.

9. A catalyst delivery system for a combustion engine comprising:

an amount of liquid containing at least one catalyst;

a hollow chamber having a collection area for the liquid;

a piezoelectric disc for transforming the liquid into a micro aerosol, wherein the piezoelectric disc is coupled to the hollow chamber, below the collection area;

a top cover sealing a top portion of the hollow chamber, wherein the cover has an opening for delivering the micro aerosol from the hollow chamber to an air intake of the combustion engine;

a bottom cover sealing a bottom portion of the hollow chamber;

a delivery tube for delivering the aerosol from the hollow chamber to the air intake, wherein the delivery tube passes through the opening of the top cover, the delivery tube having a first end located within the hollow chamber and above the collection area and having a second end located within the air intake; and a control mechanism for maintaining a constant level of liquid in the collection area.

10. The catalyst delivery system of claim 9 wherein the control mechanism comprises:

a housing containing additional liquid;

a pump;

an inlet valve coupled to the collection area;

an outlet valve for draining liquid from the collection area, wherein the outlet valve is coupled below the inlet valve and at the desired level;

tubing connecting the housing to the inlet valve; and tubing connecting the housing to the outlet valve.

11. The catalyst delivery system of claim 9 further comprising open cell foam placed within the collection area for preventing splashing within the collection area.

12. The catalyst delivery system of claim 9 wherein the top cover also has a pressure balance hole.

13. The catalyst delivery system of claim 9 wherein the second end of the tube is T-shaped.

14. The catalyst delivery system of claim 9 further comprising a splashguard coupled to the first end of the delivery tube for preventing large particles from entering the delivery tube.

15. The catalyst delivery system of claim 14 wherein the splashguard disc is a porous screen.

16. A method for delivering catalyst to a combustion engine comprising the steps of:

providing a dry micro fog device comprising:

a hollow chamber having a collection area;

a piezoelectric disc coupled to the hollow chamber and coupled below the collection area;

a top cover sealing a top portion of the hollow chamber, wherein the cover has an opening;

a delivery tube for delivering the aerosol from the hollow chamber to an air intake of a combustion engine, wherein the delivery tube passes through the opening of the top cover, the delivery tube having a first end located within the hollow chamber and above the collection area and having a second end located within the air intake; and a bottom cover sealing a bottom portion of the hollow chamber;

providing a liquid catalyst solution in the collection area;

vibrating the piezoelectric disc;

reducing the liquid catalyst solution to a micro aerosol, containing catalytic molecules that are between approximately 1.7 microns to 3 microns in size; and creating a venturi effect with air flowing through the air intake to draw the aerosol from the hollow chamber into the air intake through the opening of the top cover.

17. The method of claim 16 wherein the piezoelectric disc vibrates at a frequency between approximately 1.6 megahertz and 2.4 megahertz.

18. The method of claim 16 further comprising the step of maintaining a constant level of liquid catalyst within the collection area.

* * * * *